US005906320A

United States Patent [19]

Russkamp

[11] Patent Number: 5,906,320

[45] Date of Patent: May 25, 1999

[54] WIDE JET NOZZLE

[75] Inventor: Dieter Russkamp, Mönchengladbach, Germany

[73] Assignee: Eduard Küsters Maschinenfabrik GmbH & Co., Krefeld, Germany

[21] Appl. No.: 08/894,510

[22] PCT Filed: Jan. 16, 1996

[86] PCT No.: PCT/DE96/00039

§ 371 Date: Aug. 20, 1997

§ 102(e) Date: Aug. 20, 1997

[87] PCT Pub. No.: WO96/27042

PCT Pub. Date: Sep. 6, 1996

[30] Foreign Application Priority Data

Mar. 1, 1995 [DE] Germany ..... 295 03 446 U

[51] Int. Cl.[6] ..... B05B 1/14

[52] U.S. Cl. ..... 239/590.5

[58] Field of Search ..... 239/500, 518, 239/521, 522, 553, 590, 590.5

[56] References Cited

U.S. PATENT DOCUMENTS 4,132,363 1/1979 Krüger .

4,347,805 9/1982 Ernest ..... 118/63

FOREIGN PATENT DOCUMENTS

| | | |
|---|---|---|
| 2 469 212 | 5/1981 | France . |
| 243733 | 11/1965 | Germany . |
| 1 410 047 | 10/1968 | Germany . |
| 2 334 998 | 1/1975 | Germany . |
| 2 504 856 | 8/1976 | Germany . |
| 2 822 977 | 12/1987 | Germany . |
| 3 808 698 | 9/1989 | Germany . |

*Primary Examiner*—Andres Kashnikow
*Assistant Examiner*—Dinh Q Nguyen
*Attorney, Agent, or Firm*—Kenyon & Kenyon

[57] ABSTRACT

A wide jet nozzle for applying a bath to a substrate such as a textile web. The nozzle has a housing made of bent sheet metal upon which a discharge port is formed by two bent nozzle lips which lie parallel to one another, extend in the longitudinal direction of the housing, and define a discharge jet plane. A single feed conduit is provided which discharges transversely to the jet plane into the housing. Further provision is made in a plane transverse to the longitudinal direction of housing and intersecting the axis of section, adjacent to housing, of feed conduit for at least three deflection surfaces, one after the other in the direction of flow, which are generally transverse to the local direction of flow and off of which the flow is able to be deflected in each case by 90°.

9 Claims, 2 Drawing Sheets

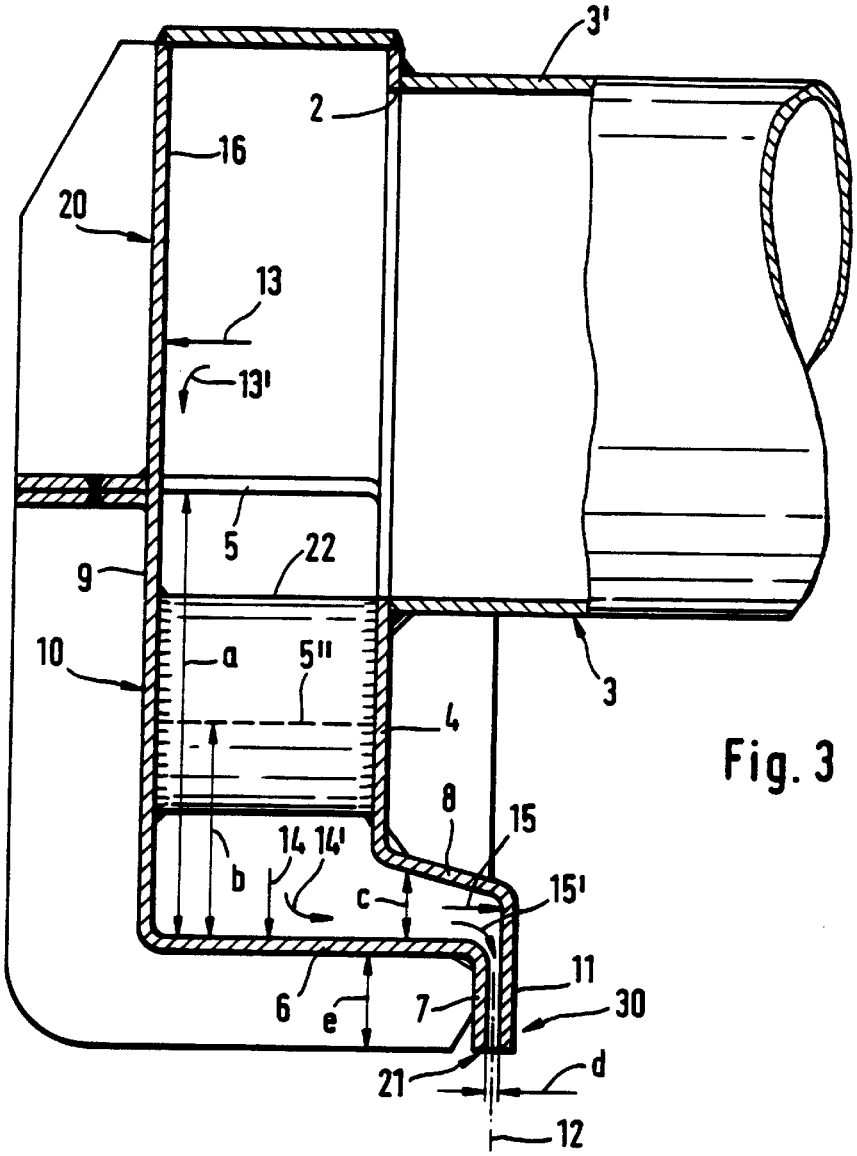
Fig. 3
Fig. 4
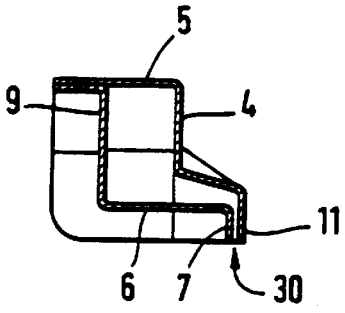
Fig. 5
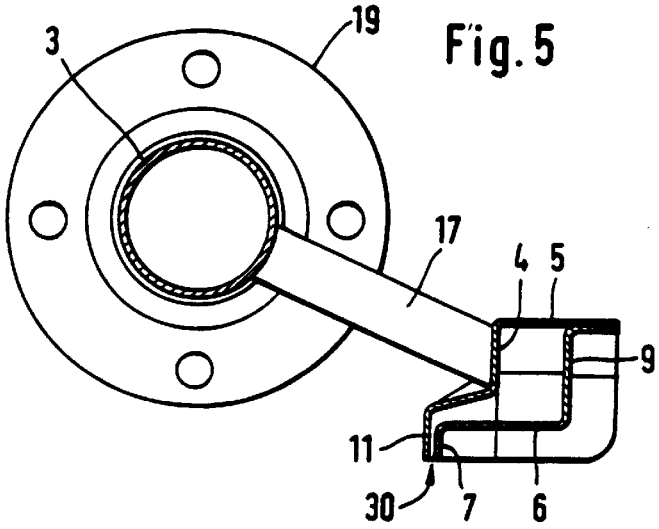

WIDE JET NOZZLE

BACKGROUND OF THE INVENTION

The invention relates to a wide jet nozzle of the type having an elongated housing made of bent sheet metal and extending over the width of a substrate, such as a web of textile. A discharge port is located on the housing, and defines a discharge plane.

The German patent 25 04 856 C 3 discloses a wide jet nozzle, whose fluid medium, e.g. wash water for textile webs, is fed from one end in the longitudinal direction of the housing of the wide jet nozzle. The housing is tapered from the feed end toward the opposite end, so that the flow cross-section decreases and the pressure remains somewhat constant over the width of the jet. Nevertheless, a one-sidedness (i.e., a degree of unevenness in the flow) of the nozzle jet is not easily avoided in this specific embodiment. This one-sidedness results in a degree of lateral application of force to the web which, for the most part, must be avoided.

For this purpose, German Patent 23 34 998 A 1 discusses combining two such wide jet nozzles with one another, each of the nozzles extending from the web center to one web edge and, in each case, the fluid medium being fed via a feed conduit extending in the longitudinal direction of the housing of the two wide jet nozzles and discharging in the center.

This specific embodiment is costly and has design disadvantages having to do with the necessity of feeding the fluid medium from the two sides.

SUMMARY OF THE INVENTION

The present invention is directed to the problem of developing a wide jet nozzle of this type that will not function unevenly, so that feeding the fluid medium will require less outlay for construction and less space. The apparatus comprises an elongated housing having a median plane and a longitudinal axial direction. The housing is made of bent sheet metal and is sized to extend over the width of the substrate. Two mutually opposing, parallel, bent nozzle lips extending in the longitudinal direction of the housing define a discharge port and a discharge jet plane.

A single feed conduit is located in the center of the housing (viewed transversely to the direction of fluid flow into the housing) and discharges fluid into the housing transversely to the discharge jet plane.

At least three deflection surfaces, one following the other in the direction of flow, which are approximately transverse to the local direction of flow and off of which the flow is in each case deflected by 90°, are provided. These deflection surfaces are located along a plane transverse to the longitudinal direction of the housing.

The single feed conduit discharges from above or below into the wide jet nozzle, so that the one-sidedness from the feed direction is suppressed. Although the feed takes place at only one location in the center of the wide jet nozzle, care is taken to even cut the discharge pressure through a repeated deflection of the fluid, while avoiding any preference for the area surrounding the center.

To even out the outflow toward the edges, provision can also be made in the case of the present invention for the housing cross-section to be reduced in a generally known way from the center toward both sides.

To achieve an adequate inlet cross-section, the feed conduit can empty into a specially provided bulge of the housing.

In order to better even out the bath discharge, a tubular baffle member can be disposed between the inner walls of the housing in a median plane below the feed conduit, its diameter being approximately one third to one half the diameter of the feed conduit.

The ratio of the length of the nozzle lips length e to the nozzle width d is at least 8:1; again to even out the bath discharge. (The expression "bath" is intended to include treatment fluids of any type thus, besides pure water, for example, dyeing fluids, wetting-agent liquors and other finishing fluids, as well.)

BRIEF DESCRIPTION OF THE DRAWINGS

Referring now to the drawings, wherein like numerals indicate like parts throughout, the principal components of a preferred embodiment of the invention are illustrated.

FIG. 3 shows a section along the Line III—III in FIG. 1, on a greatly enlarged scale;

FIGS. 4 and 5 show cross-sections along the Lines IV—IV or V—V in FIG. 1, on a less enlarged scale.

DETAILED DESCRIPTION

Figure 1:
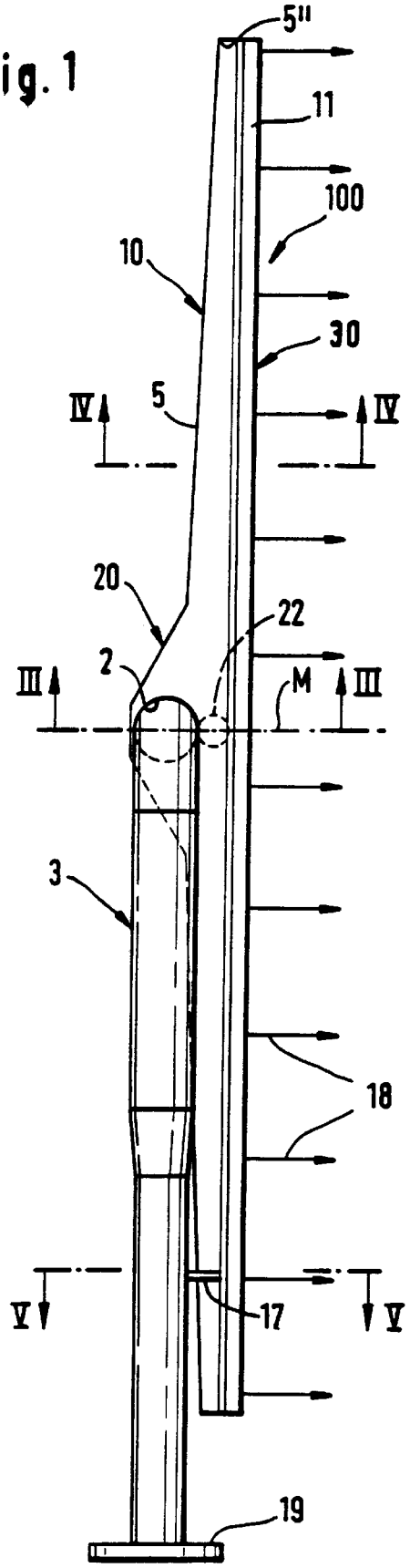
FIG. 1 shows a view of a wide jet nozzle constructed according to the principles of the invention.

The wide jet nozzle, denoted as a whole in FIG. 1 by reference numeral 100, comprises an elongated housing 10 of beveled and welded sheet metal which is closed upon itself except for a discharge port 30 extending over the length of housing 10 and a feed orifice 2. The housing 10 has a rectangular cross-section with an upper boundary wall 5, a lower boundary wall 6, and a right and left boundary wall 4, 9 according to FIG. 3 as further shown in FIGS. 4 and 5. Housing 10 is constructed symmetrically with respect to a median plane M that is transverse to the longitudinal direction of the housing and runs through the center of feed orifice 2. FIG. 1 reveals that the cross-section of housing 10 is reduced starting from the median plane M to the two ends in order to compensate for the pressure drop in the flowing bath.

In the area of median plane M, housing 10 has a bulge 20 that is symmetrical with respect to median plane M and projects toward the side facing away from discharge port 30, and in the area of said bulge 20, feed conduit 3 empties at feed orifice 2 into the interior of bulge 20 of the housing 10. The emptying takes place transversely to the discharge jet plane which, in FIG. 1, lies parallel to the drawing plane. In the exemplary embodiment, feed conduit 3 comprises a 90° pipe elbow 3', which empties into feed orifice 2 and from which feed conduit 3 continues, laterally displaced, in a straight line and, at its end situated outside of the working width, has a connecting flange 19. Housing 10 and feed conduit 3 are joined together in the edge area by a crosspiece 17.

As is apparent from FIG. 3, housing 10 and bulge 20 have approximately rectangular cross-sections of equal width. The outline of bulge 20 in the plane of FIG. 1 is that of a trapezoid disposed symmetrically to median plane M. Feed orifice 2 is located in the common boundary wall 4 of housing 10 and bulge 20. The cross-section of feed orifice 2 lies predominantly in the region of bulge 20 and only slightly in the region of housing 10. The large cross-section of feed conduit 3, apparent from FIG. 3, can be accommodated in this manner. Upper boundary wall 5 of housing 10 is cut away in the area of bulge 20, as is indicated by the missing shaded portion. A large, closed cross-section, greater than the cross-section of feed conduit 3, is provided in this area for the bath overflow from bulge 20 into housing 10. The formation in the area of bulge 20 assures a deceleration of the efflux and a uniform distribution of the liquid volume on both sides.

In the region of median plane M, the position of upper boundary wall 5 corresponds to the unshaded position in FIG. 3, the inner distance from lower boundary wall 6 being a. The position of an edge situated in outer comer 5" (FIG. 1) is likewise indicated in FIG. 3. Here, the inner distance to the lower boundary wall 6 is only b, which, in the exemplary embodiment, is approximately half of a. Accordingly, the cross-section of housing 10 to the outside is also reduced to this amount.

Figure 2:
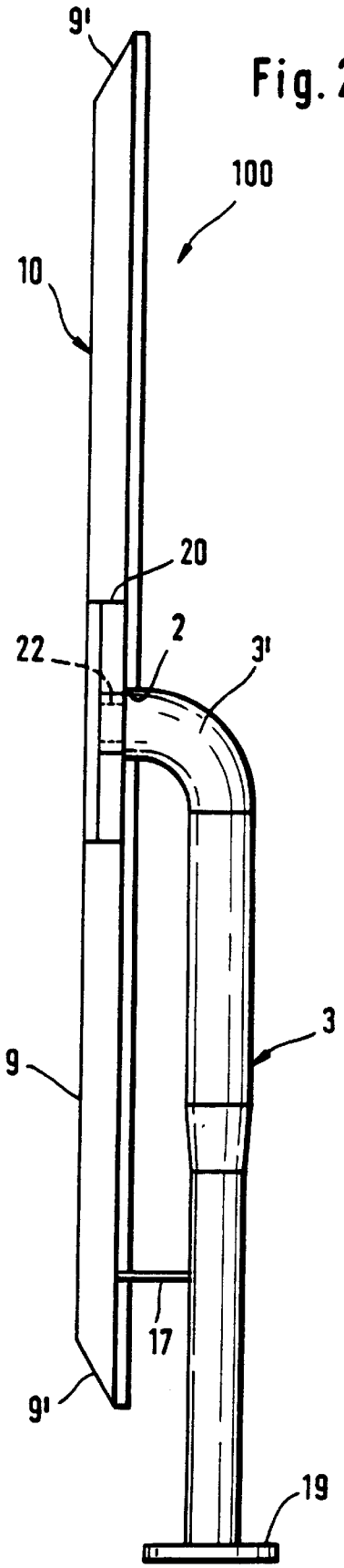
FIG. 2 shows a view of the wide jet nozzle according to FIG. 1 as viewed from the left.

As can be seen in FIG. 2, at the ends of housing 10, the left boundary wall 9 in FIGS. 2 and 3 has a beveled surface 9' so as to run to the outside, so that the inner cross-section continuously narrows and dead corners are avoided. Furthermore, housing 10 is free over its entire length of interior components such as baffles, reinforcements and the like, so that no unevenness can occur in the discharge flow.

To reduce the impact pressure in the area of the bath inflow, provision is made in housing 10 at the location of the mouth of feed conduit 3 on the side of discharge nozzle 30 for a baffle member 22 in the form of a pipe section welded between boundary walls 4 and 9, with the axis transverse to said boundary walls, the diameter of said baffle member 22 being approximately one third to one half that of feed conduit 3, and its top (apex) according to FIG. 3 being aligned with the lowest point of feed conduit 3. A free flow cross-section remains in housing 10 below baffle member 22. Baffle member 22 is circumflowed and prevents a "hole" from forming in the emergent stream in the area of feed conduit 3.

On the side of the inlet of feed conduit 3, lower boundary wall 6 has an outwardly directed, right-angled bend which forms a nozzle lip 7 in the form of a planar boundary of discharge port 30. Right boundary wall 4 of housing 10 in FIG. 3 is reduced in cross-section in a step 8 and is likewise bent to form a nozzle lip 11 disposed opposite and parallel to nozzle lip 7 with a small clearance d. It forms the other boundary of discharge port 30. Nozzle lips 7, 11, formed by planar bends, define jet plane 12 of the flat bath stream emerging from housing 10. The ratio of nozzle-lip length e to nozzle width d should not be less than 8:1, where e is the length measured in the direction of flow, over said length, nozzle lips 7, 11 being parallel to one another, d being their inside clearance. In one exemplary embodiment, e is 18 mm and d is 2 mm. Thus, the stream should maintain a certain guide length that is conducive to its evenness. The free edges of nozzle lips 7, 11 should end in a sharp edge at discharge edge 21 to produce an exact stream. This is particularly important when working with smaller, interspersed bath volumes.

The bath enters through feed conduit 3 at feed orifice 2 into the interior of bulge 20 and housing 10. In conformance with its direction of flow in feed conduit 3, said bath strikes at 13 against the left boundary wall 16 of bulge 20 in FIG. 3, which merges into boundary wall 9 of housing 10, and, because the only efflux possibility is located there, is deflected there for the first time in the direction of arrow 13'. The bath then strikes at 14 with its new direction of flow against lower boundary wall 6 and is deflected to the right in the direction of arrow 14' (FIG. 3). In this context, the bath meets a narrowed flow cross-section c and, at 15, strikes against the inner side of lower nozzle lip 11, to be deflected in the direction of arrow 15' into discharge port 30, in which flow cross-section c narrows considerably once more. The decrease in the flow cross-section toward discharge port 30 results in an impact pressure which distributes the bath toward the two sides, thus transversely to the drawing plane of FIG. 3. Because of the three-time deflections 13', 14', 15', in conjunction with the narrowing of the cross-section, the discharge pressure evens out along the discharge port, i.e. transversely to the drawing plane of FIG. 3. By properly dimensioning the beveling angle of the upper boundary face 5 with respect to the lower boundary face 6, and the cross-sections in the area of discharge port 30, a largely uniform distribution of the water volume in the discharge jet 12 can be achieved per unit of length along discharge port 30, the direction of the emergent flow over the entire extent of wide jet nozzle 100 being uniformly transverse to the straight discharge edge 21, as indicated by arrows 18 in FIG. 1. This is important if the web is constituted by pile goods, so that the pile is not turned round. At most, a slight spreading of the discharge jet is noted in response to higher pressures, through which a gentle width-retaining effect is given.

What is claimed is:

1. A wide jet nozzle for applying a bath to a textile web as it is conveyed past the wide jet nozzle, comprising:

an elongated housing having a median plane and a longitudinal axis defining a longitudinal direction, said housing being made of bent sheet metal and being sized to extend over the width of the substrate, said housing having two mutually opposing, parallel, bent nozzle lips extending in the longitudinal direction of the housing that define a discharge port and a discharge jet plane;

a single feed conduit connected to the center of the housing as viewed transversely to the direction of fluid delivery, said feed conduit discharging into said housing transversely to the discharge jet plane along an axis; and at least three deflection surfaces, one following the other in the direction of flow, which are approximately transverse to the local direction of flow and off of which the flow is able to be deflected in each case by 90°, said deflection surfaces having orthogonals that are located on a plane transverse to the longitudinal direction of housing and intersecting the axis of a section of the feed conduit adjacent to the housing.

2. A wide jet nozzle as set forth in claim 1, wherein the cross-section of housing is reduced from the housing median plane at the center of the housing toward both sides of the housing.

3. A wide jet nozzle as defined by claim 1, wherein the housing further comprises:

a bulge located in the center of the housing on that side of the housing that is removed from the discharge port, said bulge being parallel to the jet plane and being configured symmetrically with respect to the median plane of the housing, projecting toward the side removed from the discharge port and being in fluid communication with the interior of housing;

wherein the feed conduit opens into said bulge along at least a portion of its cross-section.

4. A wide jet nozzle as defined by claim 2, wherein the housing further comprises:

a bulge located in the center of the housing on that side of the housing that is removed from the discharge port, said bulge being parallel to the jet plane and being configured symmetrically with respect to the median plane of the housing, projecting toward the side removed from the discharge port and being in fluid communication with the interior of housing;

wherein the feed conduit opens into said bulge along at least a portion of its cross-section.

5. A wide jet nozzle as defined by claim 3, further comprising:

a tubular baffle member located within the interior of the housing and disposed between inner walls of the housing so as to bridge said inner walls, said tubular baffle member being arranged in the median plane below the feed conduit, and having an inner diameter that is approximately one third to one half the diameter of feed conduit.

6. A wide jet nozzle as defined by claim 4, further comprising:

a tubular baffle member located within the interior of the housing and disposed between inner walls of the housing so as to bridge said inner walls, said tubular baffle member being arranged in the median plane below the feed conduit, and having an inner diameter that is approximately one third to one half the diameter of feed conduit.

7. A wide jet nozzle as defined by claim 1, wherein the nozzle lips protrude out of a plane of the housing a distance e and are spaced apart a distance d, and the ratio of e to d is at least 8:1.

8. A wide jet nozzle as defined by claim 2, wherein the nozzle lips protrude out of a plane of the housing a distance e and are spaced apart a distance d, and the ratio of e to d is at least 8:1.

9. A wide jet nozzle as defined by claim 6, wherein the nozzle lips protrude out of a plane of the housing a distance e and are spaced apart a distance d, and the ratio of e to d is at least 8:1.

* * * * *